United States Patent [19]

Duke

[11] 4,028,053

[45] June 7, 1977

[54] FIRE RETARDANT FABRICS AND METHOD FOR PREPARATION THEREOF

[75] Inventor: Marshall W. Duke, Aiken, S.C.

[73] Assignee: United Merchants and Manufacturers, Inc., New York, N.Y.

[22] Filed: Feb. 18, 1975

[21] Appl. No.: 550,295

Related U.S. Application Data

[63] Continuation-in-part of Ser. No. 314,532, Dec. 13, 1972, abandoned.

[52] U.S. Cl. ..... 8/116 P; 427/390 D; 428/921

[51] Int. Cl.[2] ..... D06M 1/00

[58] Field of Search ..... 8/116 P; 427/390; 428/921

[56] References Cited

UNITED STATES PATENTS

| | | | |
|---|---|---|---|
| 2,709,141 | 5/1955 | Burks | 428/254 |
| 3,374,107 | 3/1968 | Cotton | 427/377 |
| 3,421,923 | 1/1969 | Guth | 427/337 |
| 3,523,033 | 8/1970 | Verburg et al. | 427/354 |
| 3,546,006 | 12/1970 | Verburg et al. | 427/377 |
| 3,577,270 | 5/1971 | Guth et al. | 427/381 |
| 3,754,981 | 8/1973 | Nachbur et al. | 427/381 |
| 3,936,562 | 3/1976 | Duke et al. | 428/921 |

*Primary Examiner*—Donald Levy
*Assistant Examiner*—W. Schulz
*Attorney, Agent, or Firm*—Michael A. Caputo; John P. McGann

[57] ABSTRACT

A process for rendering cellulose and cellulose containing fabrics fire resistant by first impregnating the fibers with a solution of an aminoplast resin, an acid and an effective amount of a dialkyl phosphono methylol alkylamide to produce fire retardancy in the resulting fabric having the formula

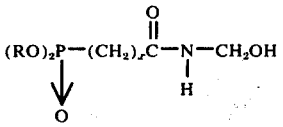

(I)

wherein R is lower alkyl having 1 to 6 carbon atoms and $x$ is an integer from 1 to 3 and polymerizing the resin while the fibers are wet and swollen. The fabric is then cured, washed and dried. The fabric obtained from this process possesses high fire-retardancy values, soft hand, and tensile values similar to that of the untreated fabric.

10 Claims, No Drawings

FIRE RETARDANT FABRICS AND METHOD FOR PREPARATION THEREOF

CROSS-REFERENCE TO RELATED APPLICATIONS

This application is a continuation-in-part of our copending application, Ser. No. 314,532, filed Dec. 13, 1972, the contents of which are incorporated herein by reference.

BACKGROUND OF THE INVENTION

1. Field of the Invention

This invention pertains to the field of fire retardant textile fabrics. More particularly, this invention concerns a method of treatment of cellulose-containing fabrics to impart fire-retardancy thereto.

2. Description of the Prior Art

Numerous methods for treating cellulosic containing fabrics to render such fabrics fire-retardant have been suggested. Generally, these methods reside in the impregnation of the fabric with a fire retardant chemical.

One of the best known fire retardant chemicals, particularly for use with cellulose derived textiles, has been tetrakis (hydroxymethyl) phosphonium chloride, commonly abreviated THPC. This chemical has been used in a variety of modes and procedures including one and two stage processes in conjunction with nitrogen containing compounds, such as, aminoplast resins. (See for example U.S. Pat. Nos. 3,421,923 and 3,556,850).

All of these type processes possess one or more disadvantages, such as for example, they produce undesirable fabric stiffness or poor hand, poor durability of the fire retardant finish after washing, and reduction in tensile strength and tear strength of the treated fabrics. Additionally, certain of the processes known heretofore result in undesirable chemical deposits on the fabrics.

SUMMARY OF THE INVENTION

We have discovered a new method for rendering a cellulosic textile fabric fire retardant whereby the resulting fabric possesses not only durable fire-retardancy but also a soft hand and tensile properties similar to those of the untreated fabric.

The present process is carried out by impregnating the fibers odf a cellulose-containing fabric with an aqueous solution of an aminoplast resin, an acid having a first hydrogen dissociation constant in the range from about $1 \times 10^{-1}$ to $5 \times 10^{-5}$ and an effective amount of a dialkyl phosphono-methylol alkylamide to produce fire retardancy in the resulting fabric having the formula

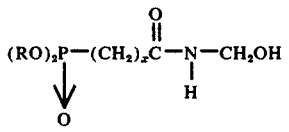

(I)

where R is lower alkyl having 1 to 6 carbon atoms and $x$ is an integer from 1 to 3, polymerizing or hardening the resin in the impregnated fabric while the fibers thereof are in a wet and swollen state, and then curing, washing and drying the impregnated fabric.

The process of the present invention may be conveniently carried out commercially and avoids the disadvantages of prior art processes as described hereinabove. Particularly, we have found that with the present process, decreased levels of the dialkyl phosphono methylol alkylamide can be used to achieve satisfactory levels of fire retardancy.

DESCRIPTION OF THE PREFERRED EMBODIMENT

The present process can be used for treating all types of cellulose-containing or derived fabrics, such as, those made from cotton fibers, regenerated cellulose, jute, manila, hemp, sisal, and ramie. Also, the present process can be used for treating blends of cellulosic-derived fabrics with synthetic fibers wherein said blends contain at last about 80 percent by weight of said cellulosic derived fabric. The process is especially useful for the treatment of cotton fabrics for clothing materials, tents and awning materials. Generally, the process of the present invention and the products obtained therefrom are advantageous in those cases where cellulose-containing materials are exposed to the danger of fire and wherein, in addition, to high flame resistance, high mechanical strength after repeated washing is required.

In accordance with the present invention, the fabric is first impregnated with a solution of a water soluble, hardenable aminoplast, an acid having a first hydrogen dissociation constant in the range from about $1 \times 10^{-1}$ to $1 \times 10^{-5}$ and an effective amount of a dialkyl phosphono-methylol alkylamide to produce fire retardancy in the resulting fabric having the formula

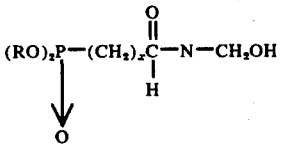

(I)

wherein R is lower alkyl having 1 to 6 carbon atoms and x is an integer from 1 to 3.

Such an impregnation can be carried out by methods well known to the art such as dipping or padding, with padding being preferred. Preferably, the amount of aminoplast applied to the fabric is in the range from about 2 to 25 percent, and most preferably from about 5 to 10 percent by weight based upon the weight of the fabric.

Water soluble, hardenable aminoplasts suitable for use in the present process primarily include hardenable aminotriazine resins that are soluble in water or possess limited solubility in water and which may be etherified. Such aminoplasts are obtained by methods well known in the art such as the condensation of formaldehyde with melamine, acetoguanamine, benzoguanamine, or formoguanamine. Mixtures of such condensation products are also suitable. Particularly preferred condensation products are those of 2–3 moles of formaldehyde with one mole of melamine.

Those condensation products of limited water-solubility are colloidal intermediate products which are first produced on further condensation beyond the crystalline methylol stage. They are characterized in that they are precipitated from the concentrated aqueous solution by the addition of water (See Kolloid-Zeitschrift, Vol. LVII, October-December 1931, page 233).

The completely water-soluble condensation products may be applied in the form of aqueous solutions. The condensation products of limited solubility may be used either in the form of solutions of the solubilized condensation products, i.e., those made soluble with acids, or in the form of emulsions.

Suitable acids for use in the present invention include phosphoric acid, and acids of substantially equivalent strength as phosphoric, e.g., oxalic, phthalic, chloroacetic, cyanoacetic, malonic, tartaric, etc.; acids which are slightly weaker than phosphoric acid, e.g., formic and acetic; and acids slightly stronger than phosphoric acid, e.g., benzene sulfonic acid and toluene sulfonic acid.

Generally, the amount of acid used is in the range from about 0.5 to 5, and preferably from about 1 to 3 weight percent based on the weight of the fabric. Particularly preferred are those compounds having the general formula I wherein R is methyl or ethyl and x is 2.

As noted, the third component of the mixture is a compound having the general formula designated by I.

Generally, the amount of compound I used is in the range from about 15 to 30 weight percent and preferably in the range from about 18 to 26 weight percent based on the weight of the fabric. In any event, sufficient amount of compound I is applied to the fabric to produce a final phosphorus content in the resulting fabric of from about 1 to 5 percent and, preferably, from about 1.4 to 2.5 percent based on the total weight of the fabric.

In addition, the solution may also contain urea as well as other nitrogenous compounds capable of reacting with the hydroxy methyl(methylol) group. These may be in quantities from about 1 to 10 weight percent and, preferably, from about 1 to 3 weight percent of the solution. Typical examples of materials are ethylene urea, propylene urea, dicyandiamide, oxamide, thiourea, polyethyleneimines, and the like.

Following the impregnation step, the aminoplast resin is polymerized while the fibers are maintained in a wet and swollen state. Such a process is generally termed "wet fixing". This polymerization may be carried out under steam and/or under pressure.

The usual process used for the polymerization is to first remove any excess of the impregnation solution from the fabric as by squeezing or centrifugation. The fabric is then stored in a closed chamber such that the fabric remains wet for the entire period of storage. The storage time depends on the temperature of storage. Thus, for example, the storage may be carried out for one minute if steam is used to control temperature, i.e., direct application of steam to the fabric; for 15 minutes if the storage temperature is 85° C; and for 20–24 hours if the temperature is room temperature. It is critical, however, that the fabric not be allowed to dry during the storage period. Thus, it may also be necessary to control the humidity of the storage chamber.

Specific methods for such wet fixing are well known in the art (see for example *Textile Research Journal*, pages 44–64, January, 1971; Bullock, J. B. and Welch C. M. Textile Research Journal 35 pages 459,471, 1965; and U.S. Pat. Nos. 3,434,875 and U.S. Pat. No. 3,546,006, incorporated herein by reference).

After the wet fixing step, the fabric is dried, usually by air drying at temperatures up to about 400° F, and preferably in the range from about 240°–290° F.

After drying, the fabric is subjected to a curing step. Generally, the fabric is cured at a temperature ranging from about 300° to 400° F for a period of time from about 2 to 20 minutes. Typically, in plant practice, a 4 to 8 minute cure at about 320° F would be used.

A major advantage of the present invention is evident in the curing step. Thus, with this present invention, a "hard" cure can be used without suffering appreciable loss of softness, tensile strength, or fabric whiteness. Contrary to most aminoplast resin systems, this invention allows a second curing without appreciable damage, if indicated, to increase phosphorus fixation for better fire retardancy.

The fabric may also be subjected to a peroxidation step in order to eliminate any possible odor when the fabric is wet and to avoid losses in fire-retardancy when the fabric is exposed to sunlight. The peroxidation step involves treatment with an oxidant, such as, for example, hydrogen peroxide or sodium perborate. The peroxidation may be carried out at elevated temperatures in a continuous process such as in an "open soaper" or batchwise in a dye beck. Alternately, the oxidant may be padded onto the fabric while cold, followed by holding the fabric in a wet state for from about 0.5 to 18 hours and then rinsing the fabric. Such perioxidation methods are conventional in the art and the particular method used is not critical to the present invention.

A preferred back wash procedure utilizes a two-stage treatment. The first stage is a wash with alkali to neutralize any acidity and the second stage is an alkaline peroxidation to avoid residual odor in the fabric. In mill practice, an open soaper, jig or beck may be used to apply soda ash followed by a mixture of soda ash and sodium perborate. The fabric is then rinsed and dried in the conventional manner.

The resulting fabric possesses a soft hand, durable fire retardancy and tensile properties similar to those of the fabric prior to treating. Such fabric is characterized by a phosphorus content in the range from about 1 to 5 percent by weight and a nitrogen content in the range from about 1 to 6 percent by weight, all weights being based on the weight of the fabric.

The following examples illustrate analyses were used:

In the examples, the following analyses were used:

Nitrogen was determined by the Kjeldahl method as set forth in "Analytical Methods for a Textile Laboratory", Second Edition, American Association of Textile Colorists and Chemists, page 155.

Phosphorus was determined by the methods set forth in "Organic Function of Group Analysis by Micro and Semi-Micro Methods", Cheronis and M. A. Wiley, 1964, pages 551–554.

Fabric hand was determined by subjective evaluation of two or more qualified fabric examiners. Stiffness was determined by ASTM method D 1388-64.

Tensile strength was measured by the Grab tensile method (ASTM D 1682-64).

Fire retardancy was measured by Department of Commerce DOC, FF 3-71 or AATCC 34-1969.

EXAMPLE 1

An 100% cotton flannelette is impregnated with 10% by weight of a methylated trimethylolmelamine resin, 22% by weight of methyl phosphono methylol propionamide, 3% by weight of phosphoric acid and 1% by weight of urea. The fabric stretched to its finished fabric dimensions, rolled up and held wet 20 hours at room temperature. The fabric then dried. Any conventional drier, such as a tenter frame, loop drier or air-lay slack drier can be used. The dried fabric is cured at 310° F for 5 minutes, and back washed with sodium carbonate and a sodium carbonate/sodium perborate mixture in an open soaper. The fabric was then dried using steam heated cans. The resulting fabric was durably fire retardant and possessed a soft hand.

EXAMPLE 2

An "80 square" cotton print cloth was impregnated with a solution of 26 percent by weight of ethyl phosphono methylol propionamide, 5% methylated trimethylolmelamine, 3% phosphoric acid, 1% urea, and 65% water by weight. The fabric was then handled as in Example 1 through the curing step. The backwashing was carried out in a jig instead of an open soaper and the final drying was on a tenter frame instead of steam heated cans. The fabric was durably fire retardant and possessed a soft hand.

EXAMPLE 3

A pigmented printed cotton terry cloth was impregnated with a solution of 20% methyl phosphono methylol propionamide, 5% methylated trimethylolmelamine, 3% phosphoric acid, 1% urea and 71% water by weight. The fabric was then treated in accordance with the procedure set forth in Example 1. The resulting fabric possessed durable fire retardance and a soft hand.

EXAMPLE 4

A fabric composed of a blend of 13 percent polyester and 87 percent cotton (fabric weight = 5.5 ounces per square yard) was treated with the process of the present invention using two different impregnating solutions. The first impregnating composition was composed of 25% methyl phosphono methylol propionamide, 5% trimethylolmelamine and 2.4% phosphoric acid, all percents being by weight based on solids. The second composition was composed of 30 weight percent methyl phosphono methylol propionamide, ten percent trimethylolmelamine, and 2.4% phosphoric acid.

The fabrics were impregnated with the impregnation solutions in the usual manner and then stored wet for twenty hours. Thereafter the samples were dried in the conventional mill equipment at 250°–260° F. The fabrics were then cured for four minutes at 320° F and backwashed with soda ash, sodium perborate and a surfactant and then dried. The final fabrics in each case were fire retardant as measured by the vertical test of the DOC FR3-71 Sleepwear Standard. Both samples possessed good fabric properties and hand.

Variations can, of course, be made without departing from the spirit and scope of the invention.

Having thus described my invention what I desire to secure and claim by Letters Patent is:

1. A process for rendering a cellulose containing fabric fire retardant comprising:

a. impregnating the fibers of a cellulose-based fabric having a minimum cellulose content of about 80% by weight with an aqueous solution of an aminoplast resin, an acid having a first hydrogen acid dissociation constant in the range from about $1 \times 10^{-1}$ to $5 \times 10^{-5}$, and an effective amount of a dialkyl phosphono methylol alkylamide to produce fire retardancy in the resulting fabric having the formula

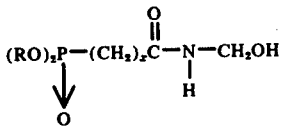

(I)

Wherein R is a lower alkyl having from 1 to 6 carbon atoms and $x$ is an integer from 1 to 3;

b. wet fixing the resin in the impregnated fabric and then c. drying the fabric;

d. curing the resin in the fabric, and e. washing and drying the fabric.

2. The process of claim 1 wherein the fabric is impregnated with sufficient aminoplast resin to produce a resin content in the final fabric in the range from about 2 to 25 percent by weight based on the total weight of the fabric.

3. The process of claim 1 wherein the fabric is impregnated with a sufficient amount of said dialkyl phosphono-methylol alkylamide to produce a phosphorous content in the final fabric in the range from about 1 to 5 percent by weight based on the total weight of the fabric.

4. The process of claim 1 wherein the amount of said acid is in the range from about 0.5 to 5 percent by weight based on the weight of the fabric.

5. The process of claim 1 wherein the composition of the impregnating solution is:

acid: about 1 to 3 weight percent; aminoplast resin: about 5 to 10 weight percent; and dialkyl phosphono methylol alkylamide: about 18 to 26 weight percent, all weights being based on the weight of the solution.

6. The process of claim 1 wherein the impregnating solution further contains a nitrogenous compound selected from the group consisting of urea, ethylene urea, propylene urea, guanidine, dicyandiamide, oxamide, thiourea, and polyethyleneimine.

7. The process of claim 6 wherein the amount of the nitrogenous compound is in the range from about 1 to 3 weight percent based on the weight of the solution.

8. The process of claim 1 wherein subsequent to curing step (d) and prior to washing step (e) the fabric is subjected to a peroxidation step.

9. The process of claim 8 wherein just prior to said peroxidation step, the fabric is subjected to an aqueous wash under alkaline conditions.

10. The process of claim 1 wherein R is methyl and $x$ is 2.

* * * * *